US009126820B2

(12) United States Patent
Gray et al.

(10) Patent No.: US 9,126,820 B2
(45) Date of Patent: Sep. 8, 2015

(54) DISPENSING NOZZLE WITH FLUID RECAPTURE

(71) Applicants: John M. Gray, Cincinnati, OH (US); Timothy M. Garrison, Cincinnati, OH (US); Matthew R. Lauber, Cincinnati, OH (US); Harold M. Schubert, Fairfield, OH (US)

(72) Inventors: John M. Gray, Cincinnati, OH (US); Timothy M. Garrison, Cincinnati, OH (US); Matthew R. Lauber, Cincinnati, OH (US); Harold M. Schubert, Fairfield, OH (US)

(73) Assignee: OPW FUELING COMPONENTS INC., Hamilton, OH (US)

( * ) Notice: Subject to any disclaimer, the term of this patent is extended or adjusted under 35 U.S.C. 154(b) by 0 days.

(21) Appl. No.: 13/764,997

(22) Filed: Feb. 12, 2013

(65) Prior Publication Data

US 2014/0224838 A1 Aug. 14, 2014

(51) Int. Cl.

| | |
|---|---|
| ***B65D 1/16*** | (2006.01) |
| ***B67D 7/54*** | (2010.01) |
| *B67D 7/46* | (2010.01) |
| *B67D 7/48* | (2010.01) |

(52) U.S. Cl.

CPC ... *B67D 7/54* (2013.01); *B67D 7/46* (2013.01); *B67D 7/465* (2013.01); *B67D 7/48* (2013.01)

(58) Field of Classification Search

CPC ..... B67D 7/3209; B67D 7/42; B67D 7/421; B67D 7/465; B67D 7/46; B67D 7/48; B67D 7/54

USPC ..... 222/108, 110, 111, 71, 566, 571, 389, 222/320, 335, 321.3, 109; 141/59, 206, 141/311 A, 124, 392; 137/888, 312

See application file for complete search history.

(56) References Cited

U.S. PATENT DOCUMENTS

| | | | | |
|---|---|---|---|---|
| 2,547,690 | A | | 4/1951 | Chadil et al. |
| 2,582,195 | A | | 1/1952 | Duerr |
| 3,085,600 | A | | 4/1963 | Briede |
| 4,023,601 | A | | 5/1977 | Hansel |
| 4,033,389 | A | | 7/1977 | Hansel et al. |
| 4,058,149 | A | | 11/1977 | Hansel |
| 4,059,135 | A | | 11/1977 | Hansel |
| 4,103,936 | A | | 8/1978 | Sutcliffe et al. |
| 4,113,153 | A | * | 9/1978 | Wellman ..... 222/571 |
| 4,121,635 | A | | 10/1978 | Hansel |

(Continued)

FOREIGN PATENT DOCUMENTS

DE 19638845 4/1997

OTHER PUBLICATIONS

Elaflex Press Release (Aug. 11, 2008).

(Continued)

*Primary Examiner* — Frederick C Nicolas
*Assistant Examiner* — Bob Zadeh
(74) *Attorney, Agent, or Firm* — Thompson Hine LLP

(57) ABSTRACT

A nozzle including a dispensing path, where the dispensing path is configured such that fluid is dispensable through the dispensing path. The nozzle further includes a suction path, where the suction path is configured such that a negative pressure is created in the suction path when fluid flows through the dispensing path. The nozzle also has a fluid recapture path configured to capture fluid, positioned on an outside of the nozzle, in the recapture path. The fluid recapture path is in fluid communication with the dispensing path and the suction path. In this manner fluid in the fluid recapture path is directable into the dispensing path by the negative pressure in the suction path.

30 Claims, 11 Drawing Sheets

(56) References Cited

U.S. PATENT DOCUMENTS

| | | | | | |
|---|---|---|---|---|---|
| 4,213,488 | A | | 7/1980 | Pyle | |
| 4,260,000 | A | * | 4/1981 | McGahey et al. | 141/59 |
| 4,354,536 | A | | 10/1982 | Moss | |
| 4,429,725 | A | | 2/1984 | Walker et al. | |
| 4,453,578 | A | | 6/1984 | Wilder | |
| 4,557,302 | A | | 12/1985 | Sunderhaus | |
| 4,566,504 | A | | 1/1986 | Furrow et al. | |
| 4,687,033 | A | | 8/1987 | Furrow et al. | |
| 4,825,914 | A | | 5/1989 | Leininger | |
| 4,827,987 | A | | 5/1989 | Faeth | |
| 4,842,027 | A | | 6/1989 | Faeth | |
| 4,971,121 | A | | 11/1990 | Guertin | |
| 5,035,271 | A | | 7/1991 | Carmack et al. | |
| 5,197,523 | A | | 3/1993 | Fink, Jr. et al. | |
| 5,236,023 | A | | 8/1993 | Mohr | |
| 5,289,856 | A | | 3/1994 | Strock et al. | |
| 5,377,729 | A | | 1/1995 | Reep | |
| 5,385,182 | A | | 1/1995 | Dyer | |
| 5,435,357 | A | | 7/1995 | Woods et al. | |
| 5,603,364 | A | | 2/1997 | Kerssies | |
| 5,620,032 | A | | 4/1997 | Dame | |
| 5,645,116 | A | | 7/1997 | McDonald | |
| 5,655,576 | A | | 8/1997 | Leininger et al. | |
| 5,813,443 | A | * | 9/1998 | Dalhart et al. | 141/206 |
| 5,975,165 | A | * | 11/1999 | Motosugi et al. | 141/392 |
| 6,311,742 | B1 | | 11/2001 | Nusen et al. | |
| 6,520,222 | B2 | | 2/2003 | Carmack et al. | |
| 6,676,029 | B2 | | 1/2004 | Mitchell | |
| 6,810,920 | B1 | | 11/2004 | Rolling | |
| 6,854,491 | B1 | | 2/2005 | Knight et al. | |
| 6,941,984 | B2 | | 9/2005 | Knight | |
| 6,983,772 | B1 | | 1/2006 | Lawrence et al. | |
| 6,997,220 | B1 | | 2/2006 | Knight et al. | |
| 7,000,657 | B1 | | 2/2006 | Thorpe et al. | |
| 7,036,536 | B1 | | 5/2006 | Knight et al. | |
| 7,063,112 | B2 | | 6/2006 | Fink, Jr. et al. | |
| 7,082,972 | B1 | | 8/2006 | Healy | |
| 7,134,580 | B2 | | 11/2006 | Garrison et al. | |
| 7,216,680 | B2 | | 5/2007 | Lawrence et al. | |
| 7,234,614 | B1 | | 6/2007 | Knight et al. | |
| 7,270,154 | B2 | | 9/2007 | Walker et al. | |
| 7,575,028 | B2 | | 8/2009 | Thorpe et al. | |
| 7,735,529 | B2 | | 6/2010 | Lawrence et al. | |
| 7,748,419 | B2 | | 7/2010 | Fink, Jr. et al. | |

OTHER PUBLICATIONS

Elaflex Petrol and Chemical Hoses Catalog (2005), cover pages and pp. 236 and 237, with a detail view of part of a nozzle from p. 236.

PCT, International Search Report and Written Opinion, International Application No. PCT/US2014/015667 (Mar. 7, 2014).

* cited by examiner 96b
96c
96a
108
110
112
114
96d
74
70
72
76
78
80
82
84
86
88
90
92
94
96
98
100
102
104
106
108
110
112
114
116
118
120
122
124
126
128
130
132
134
136
138
140
142
144
146
148
150
152
154

DISPENSING NOZZLE WITH FLUID RECAPTURE

The present invention is directed to a fluid dispensing nozzle, and more particularly, to a fluid dispensing nozzle configured to recapture fluid.

BACKGROUND

Fuel and fluid dispensers are widely utilized to dispense fuels, such as gasoline, diesel, natural gas, biofuels, blended fuels, propane, oil, ethanol or the like, into the fuel tank of a vehicle or other fuel receptacles. Such dispensers typically include a nozzle that is insertable into the fuel tank of the vehicle or the receptacle when the nozzle is in a generally horizontal dispensing configuration. When refueling operations are completed, the nozzle is removed from the fuel tank/receptacle and is typically holstered or stored in a generally vertical configuration.

When the nozzle is in the holstered position any fuel or fluid on the outside of the spout may flow downwardly toward the handle of the nozzle, which can then cause the handle (or other parts of the nozzle) to become slippery and/or be transferred to the hand of an operator. In addition, fuel on the outside of the nozzle is typically wasted and can cause adverse environmental effects.

SUMMARY

In one embodiment the present invention is a nozzle with a fluid recapture feature such that fuel or dispensed fluid on the outside of the nozzle can be recaptured. More particularly, in one embodiment the invention is a nozzle including a dispensing path configured such that fluid is dispensable therethrough. The nozzle further includes a suction path configured such that a negative pressure is created therein when fluid flows through the dispensing path. The nozzle has a fluid recapture path configured to capture therein fluid positioned on an outside of the nozzle. The fluid recapture path is in fluid communication with the dispensing path and the suction path such that fluid in the fluid recapture path is directable into the dispensing path by the negative pressure.

DETAILED DESCRIPTION

Figures 1, 1A:
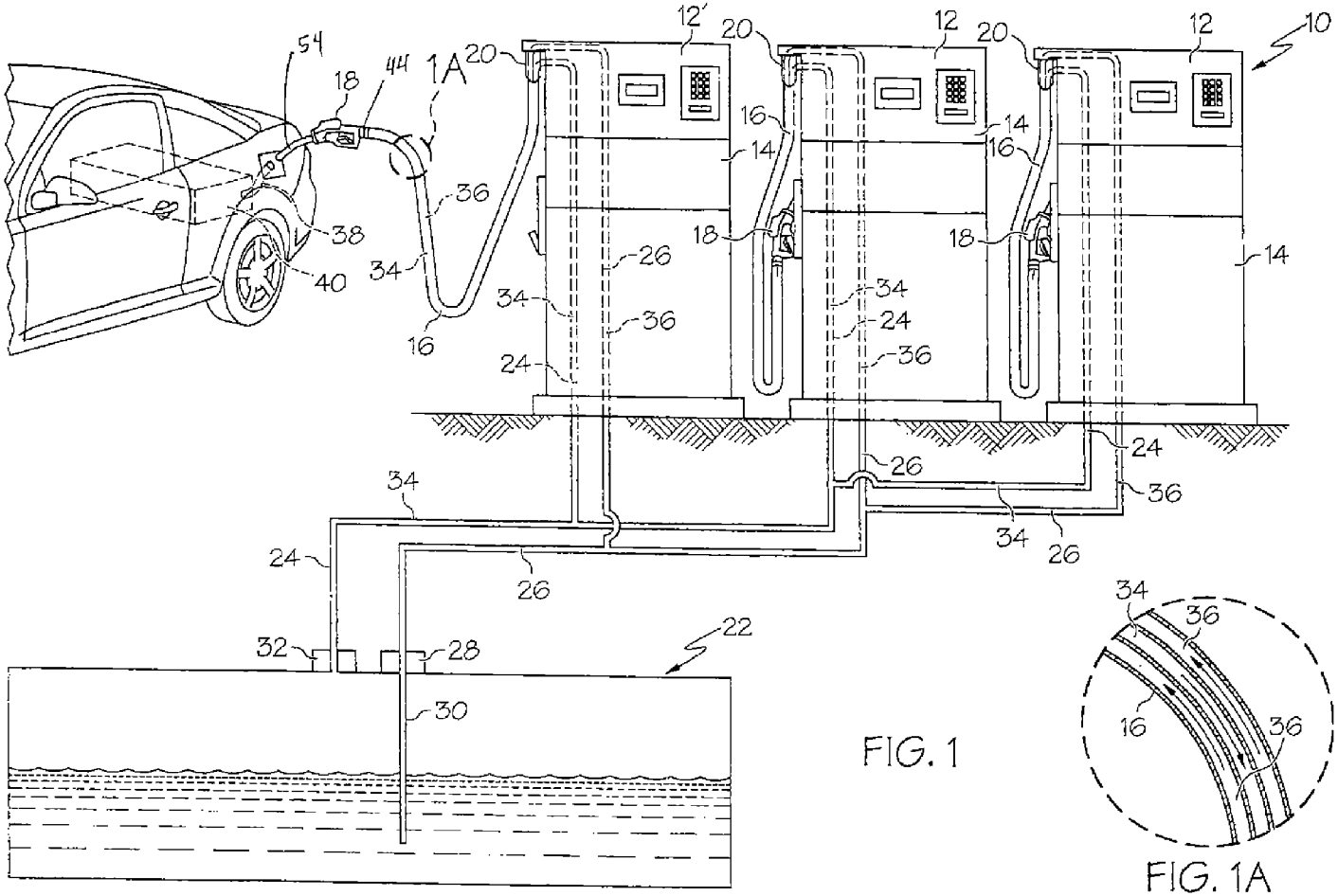
FIG. 1 is a schematic representation of a refilling system utilizing a plurality of dispensers.
FIG. 1A is a detail section of the area indicated in FIG. 1.

FIG. 1 is a schematic representation of a refilling system 10 including a plurality of dispensers 12. Each dispenser 12 includes a dispenser body 14, a hose 16 coupled to the dispenser body 14, and a nozzle 18 positioned at the distal end of the hose 16. Each hose 16 may be generally flexible and pliable to allow the hose 16 and nozzle 18 to be positioned in a convenient refilling position as desired by the user/operator.

Each dispenser 12 is in fluid communication with a fuel/fluid storage tank 22 via a fluid conduit 26 that extends from each dispenser 12 to the storage tank 22. The storage tank 22 includes or is coupled to a fuel pump 28 which is configured to draw fluid out of the storage tank 22 via a pipe 30. During vehicle refilling, as shown by the in-use dispenser 12' of FIG. 1, the nozzle 18 is inserted into a fill pipe 38 of a vehicle fuel tank 40. The fuel pump 28 is then activated to pump fuel from the storage tank 22 to the nozzle 18 and into the vehicle fuel tank 40 via a fuel path or dispensing path 36 of the system 10.

In some cases, it is desired to capture vapors expelled from the fuel tank during refilling, and route the vapors to the tank 22. In this case, a vapor path/suction path 34 extends from the nozzle 18, through the hose 16 and a vapor conduit 24 to the ullage space of the tank 22. For example, as shown in FIG. 1A, in one embodiment the vapor path 34 of the hose 16 is received within, and generally coaxial with, an outer fluid path/dispensing path 36 of the hose 16. A vapor pump or suction source 32 may be in fluid communication with the vapor path 34 to aid in the recovery of vapor expelled from the vehicle fuel tank 40 and route the captured vapors to the ullage space of the tank 22. Alternately, in some cases the vapor pump 32 may be omitted and the vapors may be urged through the vapor path 34 and to the tank 22 by the pressure of fluid entering the vehicle fuel tank 40. Further alternately, in some cases the system 10 may lack any vapor recovery features.

It should be understood that the arrangement of pumps 28, 32 and storage tank 22 can be varied from that shown in FIG. 1. In one particular example, the fuel pump 28 and/or vapor pump 32 (if utilized) can instead be positioned at each associated dispenser 12 in a so-called "suction" system, instead of the so-called pressure system shown in FIG. 1. Moreover, it should be understood that the system 10 disclosed herein can be utilized to store/dispense any of a wide variety of fluids, liquids or fuels, including but not limited to petroleum-based fuels, such as gasoline, diesel, natural gas, biofuels, blended fuels, propane, or ethanol the like, or oil, etc.

Figure 2:
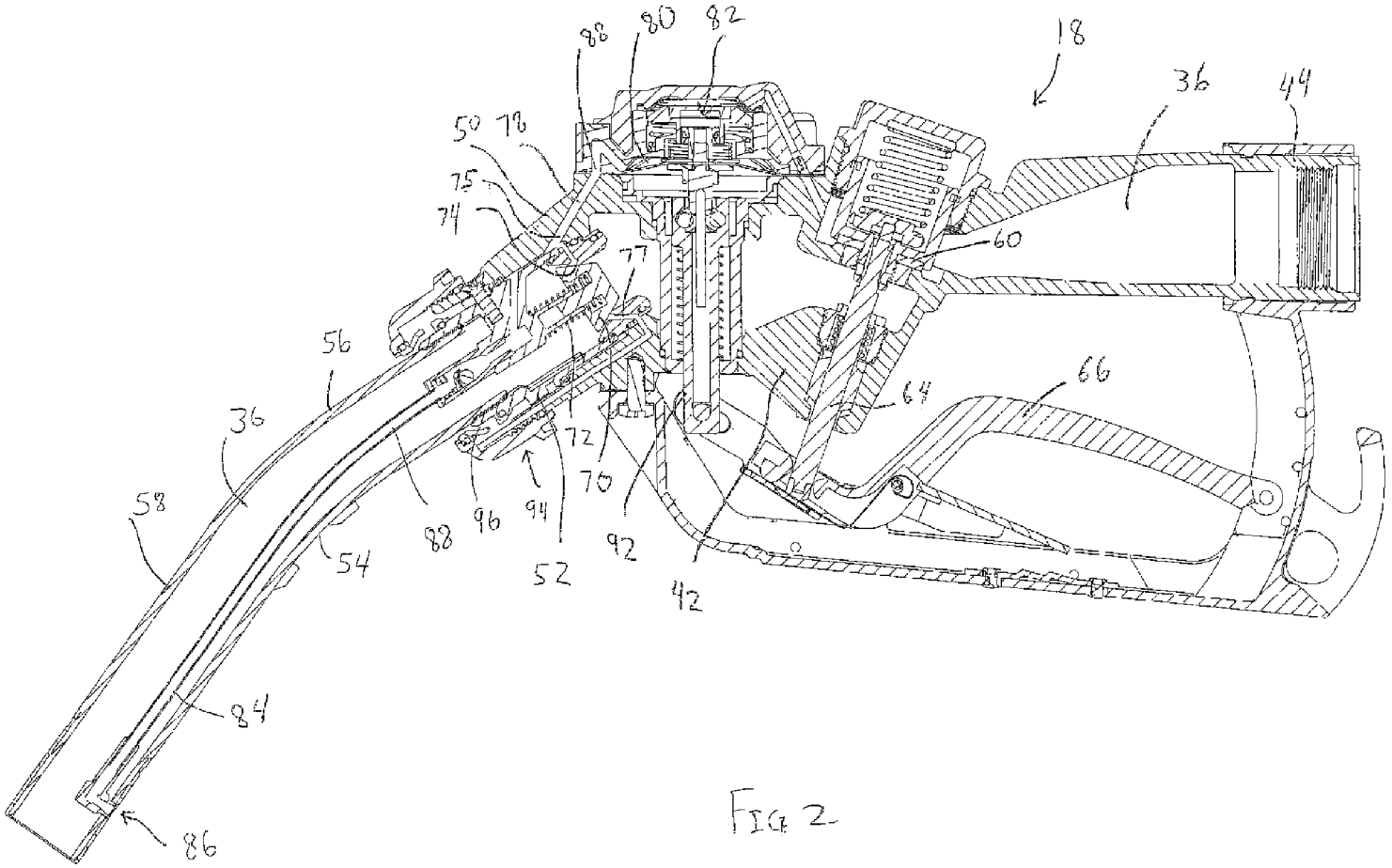
FIG. 2 is a side cross section of a nozzle of the system of FIG. 1.

With reference to FIG. 2, the nozzle 18 may include a nozzle body 42 having a generally cylindrical inlet 44 leading directly to or forming part of the main fluid path/dispensing path 36 (in the embodiment shown in FIGS. 2-11, the nozzle 18 is not a vapor recovery nozzle and therefore lacks a vapor recovery path 34). The inlet 44 is configured to be connected to an associated hose 16, such as by threaded attachment. The nozzle body 42 has an outlet 50 which receives a spout adapter 52 therein. The spout adapter 52, in turn, threadably receives a spout 54 therein that is configured to dispense liquid flowing therethrough. The spout 54 has a base or straight portion 56 and an end portion 58 that is angled downwardly relative to the base portion 56. In some cases, the nozzle 18 may include a vapor recovery boot (not shown) coupled to the spout 54 and/or spout adaptor 52, extending coaxially thereabout to trap vapors and provide an inlet to the vapor path 34.

When the nozzle body 42 is oriented generally horizontally or in a dispensing position, the portions of the main fluid path 36 immediately adjacent to the inlet 44 and/or the axis of the inlet 44 may be oriented generally horizontally, as shown in FIG. 2, and by the in-use (left-most) nozzle 18 in FIG. 1. When in the horizontal or dispensing position, part or all of a handle/lever 66 of the nozzle 18 can be positioned above a distal end of the spout 54. In addition, the end portion 58 of the spout 54 may be pointing downwardly or below horizontal, and may be the lowest portion of the nozzle 18.

The nozzle body 42 is also movable to a holstered or vertical position in which the nozzle 18 is stored, as shown the two right-most nozzles 18 in FIG. 1. When in this position, part or all of the handle/lever 66 may be positioned below the distal end of the spout 54 and/or the end portion 58 may be pointing upwardly or above horizontal, or be the upper-most portion of the nozzle 18. In one case the nozzle 18/dispenser 12 may be designed such that when the nozzle 18 is holstered, or when the end portion 58 of the spout 54 is at an angle greater than 5° above horizontal, in which case any fuel that is coating or positioned on the external surface of the spout 54 will tend to migrate downwardly along the spout 54.

The nozzle 18 can include a main fluid valve 60 positioned in the fluid path 36 to control the flow of liquid therethrough and through the nozzle 18. The main fluid valve 60 is carried on, or operatively coupled to, a main valve stem 64. The bottom of the main fluid valve stem 64 is positioned on or operatively coupled to the handle/lever 66 which can be manually raised or actuated by the user. In operation, when the user raises the lever 66 and refilling conditions are appropriate, the lever 66 engages and raises the valve stem 64, thereby opening the main fluid valve 60.

Figure 3:
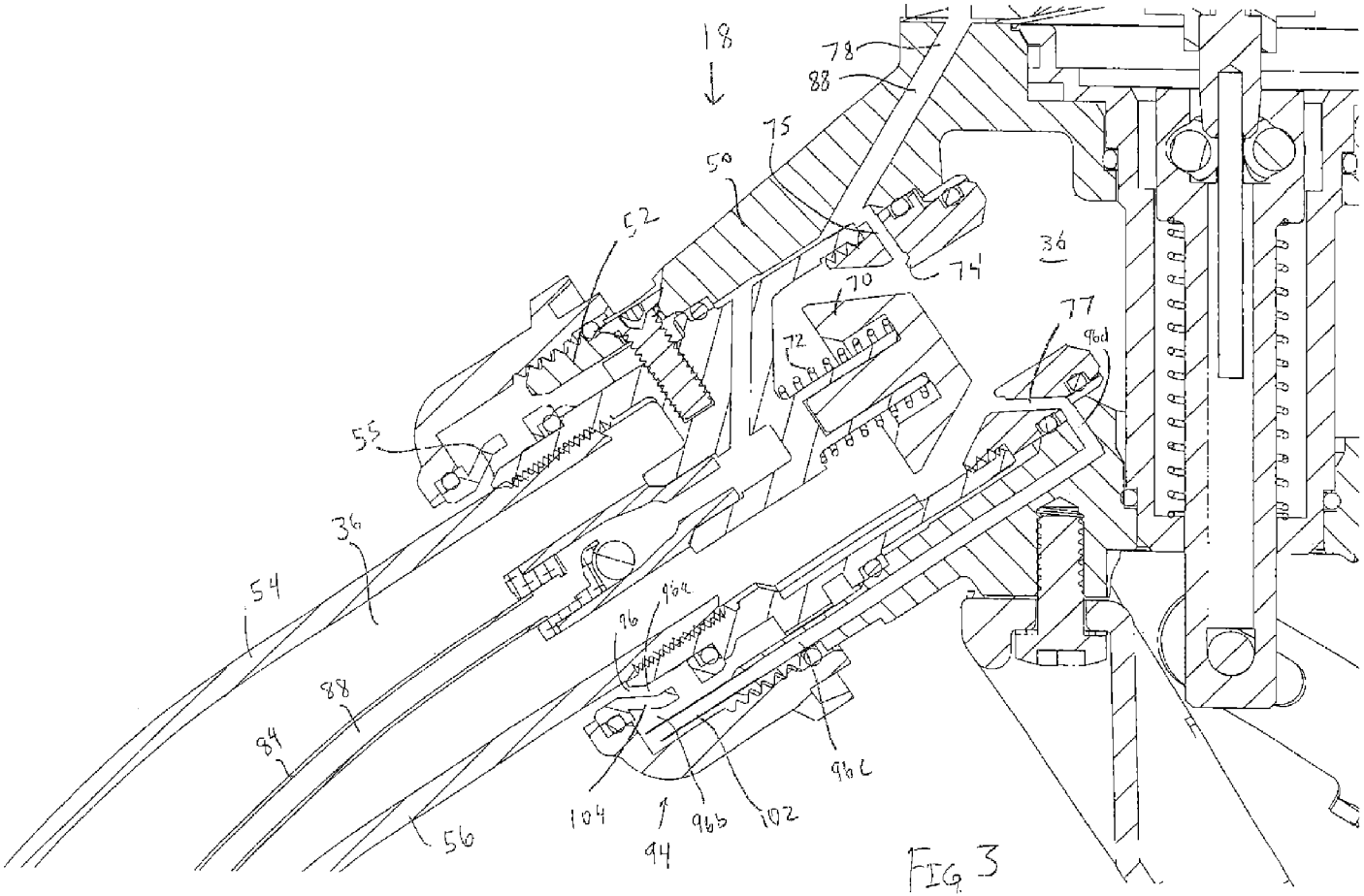
FIG. 3 is a detail view of the nozzle of FIG. 2, with the nozzle in a dispensing position.

As shown in FIG. 3, a venturi poppet or suction force generator 70 is mounted in the spout adaptor 52 and positioned in the fluid path 36. A venturi poppet spring 72 engages the venturi poppet 70 and urges the venturi poppet 70 to a closed position (FIG. 2) wherein the venturi poppet 70 engages an annular seating ring 74. When fluid of a sufficient pressure is present in the fluid path 36 (i.e., during dispensing operations), the force of the venturi poppet spring 72 is overcome by the pressure of the dispensed fluid and the venturi poppet 70 is moved to its open position, away from the seating ring 74, as shown in FIG. 3.

When the venturi poppet 70 is open and liquid flows between the venturi poppet 70 and the seating ring 74, a venturi effect is created in a plurality of passages 75 extending through the seating ring 74. The passages 75 are, in one case, radially extending, and are in fluid communication with a venturi passage 78 formed in the nozzle body 42 which is, in turn, in fluid communication with a central or venturi chamber 80 of a no-pressure, no-fill valve or shut-off valve/device 82 (FIG. 2).

The passages 75 are also in fluid communication with a tube 84 positioned within the spout 54. The tube 84 terminates at, and is in fluid communication with, an opening 86 positioned on the underside of the spout 54 at or near the distal end thereof. The tube 84, passages 75, venturi passage 78 and other portions of the nozzle 18 exposed to the venturi pressure, form or define a sensing path 88 which is fluidly isolated from the fluid flow path 36.

When the venturi poppet 70 is open and fluid flows through the fluid path 36, the venturi or negative pressure in the passages 75 and sensing path 88 draws air through the opening 86 and tube 84, thereby dissipating the negative pressure. When the opening 86 at the end of the spout 54 is blocked, such as when fluid levels in the tank 40 during refilling reach a sufficiently high level, the negative pressure is no longer dissipated, and the negative pressure is applied to the venturi chamber 80.

The decrease in pressure in the central chamber 80 of the shut-off device 82 causes a plunger 92 to move downwardly, causing the lever 66 to move to its disengaged position and the main fluid valve 60 to close, terminating flow through the nozzle 18. Thus the shut-off device 82 utilizes the negative pressure generated by the venturi poppet 70 to provide a shut-off feature which terminates refueling/fluid dispensing when fluid is detected at the tip of the spout 56. Further details relating to these features can be found in U.S. Pat. No. 2,582,195 to Duerr, the entire contents of which are incorporated herein by reference, U.S. Pat. No. 4,453,578 to Wilder, the entire contents of which are hereby incorporated by reference, and U.S. Pat. No. 3,085,600 to Briede, the entire contents of which are incorporated herein.

The nozzle 18 may include a fuel recapture component, generally designated 94. The fuel capture component 94 at least partially includes or defines a fuel recapture path 96 and is configured to capture fuel positioned on an outside of the nozzle 18/spout 54, such as when the nozzle 18 is not dispensing fluid. In particular, during use of the nozzle 18 to refuel a vehicle, container or the like, the spout 54 and/or other portions of the nozzle 18 can be coated with dispensed fuel due to, for example, submersion of the spout 54 in fluid in the vehicle tank 40, exposure to vaporized fuel or splash back and the like. When the nozzle 18 is holstered or placed in its vertical position, as shown by the two right-most dispensers 12 in FIG. 1, fuel on the spout 54 can flow vertically/downwardly along the spout 54 towards the fuel recapture component 94.

In the illustrated embodiment, and with reference to FIG. 3, the fuel recapture path 96 includes an intake path **96*a*, a return path 96*c*, and a reservoir portion 96*b* fluidly coupled to and positioned between the intake path 96*a* and the return path 96*c*. The intake path 96*a*, in one embodiment, is an open path in fluid communication with, and positioned immediately adjacent to, the spout 54. The intake path 96*a* can be annular, extending 360° around the entire perimeter of the spout 54, but can also take other shapes, or configurations, including extending less than 360° around the spout 54. In one case, the spout 54/fuel recapture component 94 can include an angled flange 55 which closely surrounds/engages the spout 54 and includes/defines an angled surface to divert downwardly-flowing fuel radially outwardly and into the intake path 96*a* when the nozzle 18. In addition, as in the illustrated embodiment, the radially inner surface of part of the intake path 96*a* can be defined by the outer surface of the spout 54**.

The reservoir portion **96*b* can be a generally annular cavity positioned radially outside the intake path 96*a*, with an annular inner baffle 104 positioned therebetween. In the illustrated embodiment the return path 96*c* is generally a tubular path, including an extension tube 102 which terminates in the reservoir portion 96*b*, at or near the low point of the reservoir portion 96*b* when the nozzle 18** is in its dispensing position.

Figure 4:
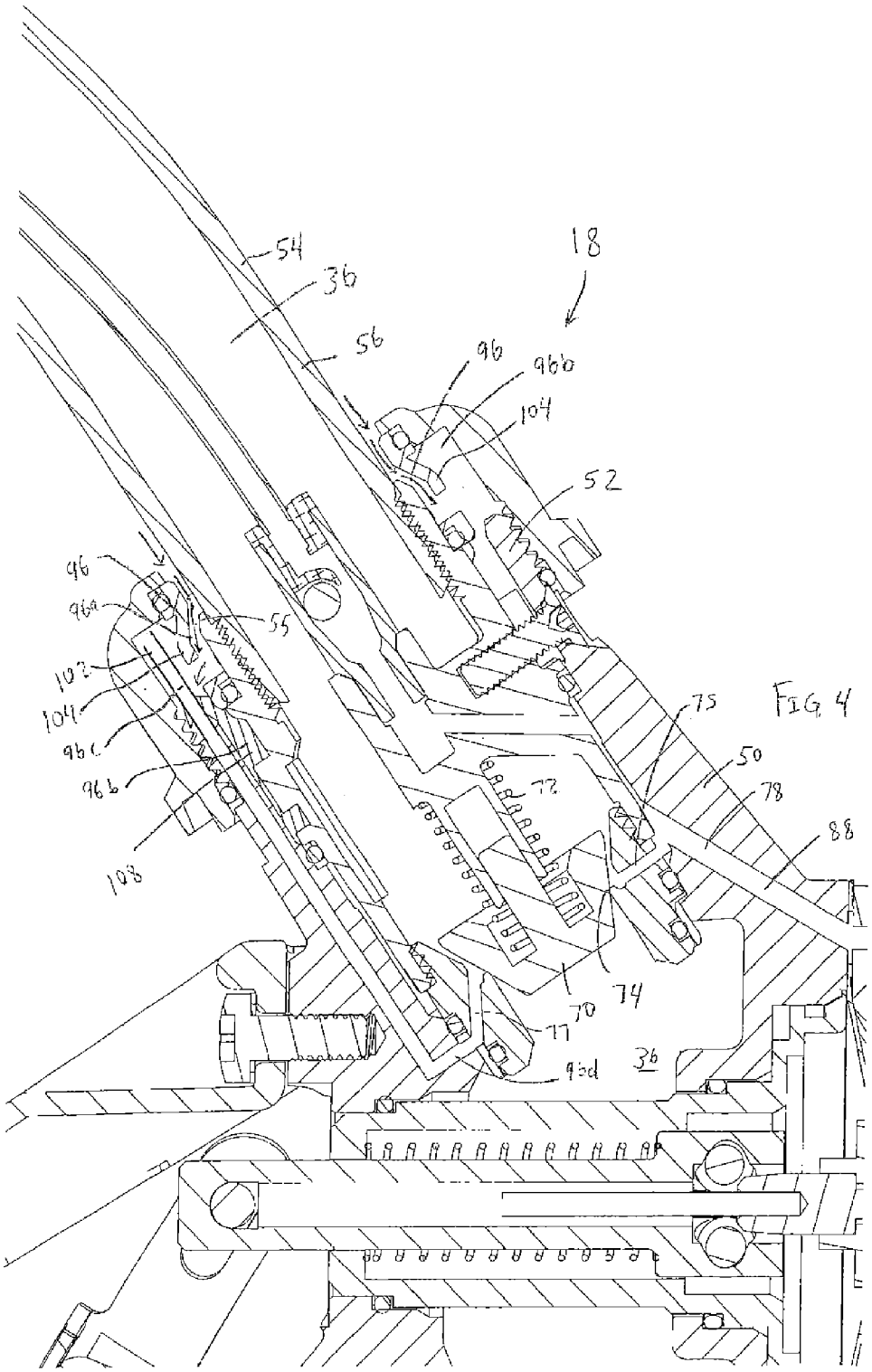
FIG. 4 is a detail view of nozzle portion of FIG. 3, with the nozzle in a storage position and with fuel in the fuel recapture path.
Figure 5:
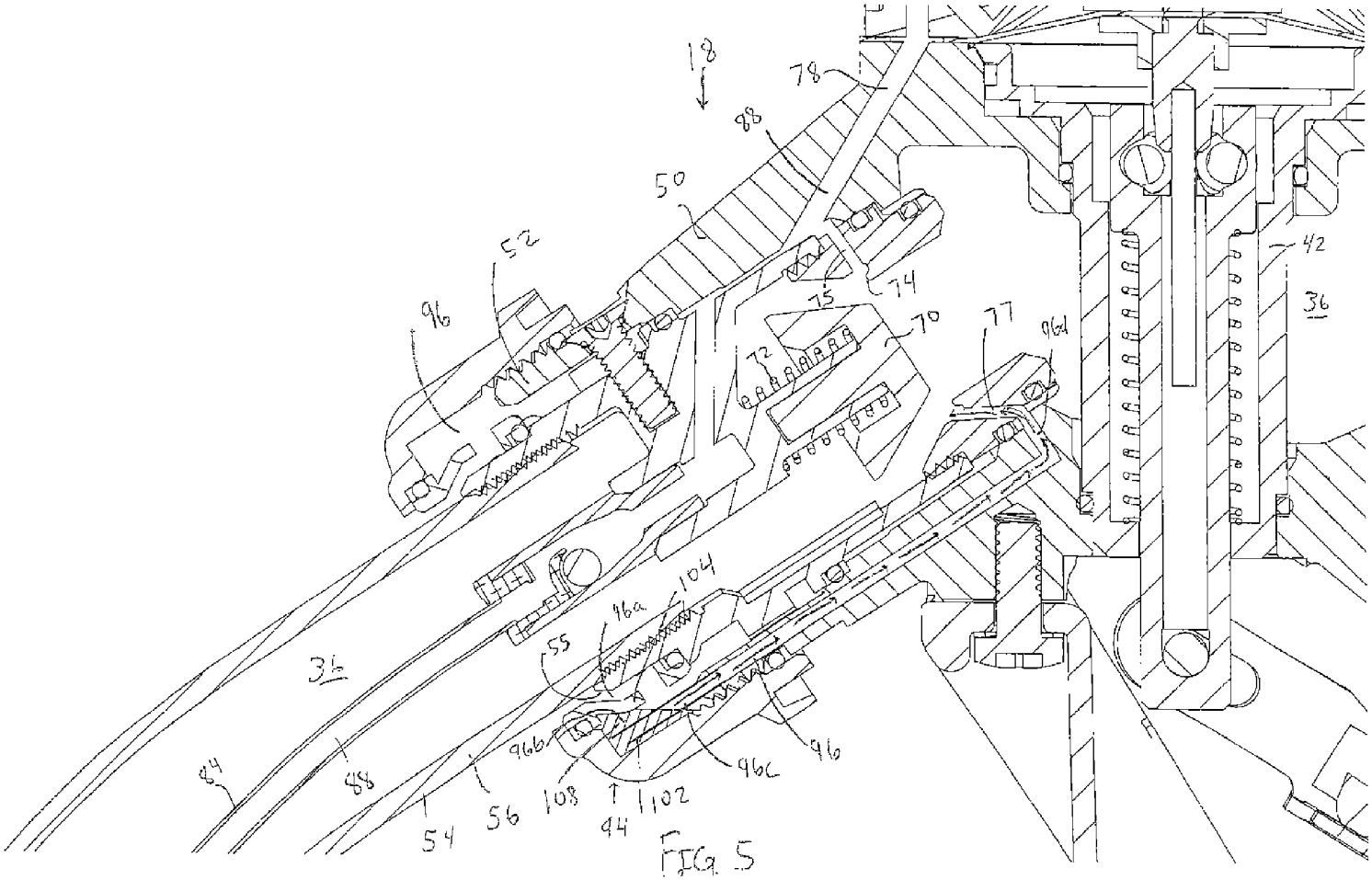
FIG. 5 is a detail view of nozzle portion of FIG. 4, with the nozzle in the dispensing position with fuel captured in the fuel recapture path.

As can be seen in FIG. 4, when the nozzle 18 is in its holstered/vertical position, fuel/fluid 108 flowing down the outer surface of the spout 54 enters the intake path **96*a*, as shown by the arrows, and pools in the lower-most portions of the intake path 96*a*/reservoir portion 96*b*. As shown in FIG. 5, when the nozzle 18 is unholstered and used for refueling the nozzle 18 is moved to its horizontal/dispensing position. Moving the nozzle 18 to such a position causes the recaptured fuel 108 to flows forwardly in the reservoir portion 96***b* and into the return path 96*c*, but is generally prevented from entering the intake path 96*a* by the inner baffle 104. In this manner, the fuel recapture component 94 defines or includes a fluid trap such that recaptured fluid 108 is stored/captured in the component 94/fluid recapture path 96 when the nozzle 18 is moved between the storage/vertical/holstered and the use/horizontal/dispensing positions. The recapture path 96 can be thus configured to allow liquid from the spout 54 to enter therein when the end portion 58 is positioned above horizontal, but generally prevents the collected liquid (or at least some of the collected liquid) from leaving through the same path when the end portion 58 is positioned below horizontal.

In one case the intake path 96*a* and/or reservoir portion 96*b* are annular and extend about 360° about the nozzle 18. However, if desired, the intake path 96*a* and/or reservoir portion 96*b* may not be completely annular and/or concentric. For example, in one case the entrance to the fuel recapture path 96 can be a single hole or passage configured to be at a bottom of the spout 56 when the nozzle 18 is holstered. In this case the fuel recapture component 94 may include an external baffle extending circumferentially about the spout 54 and configured to direct fluid toward the single hole or passage, when the nozzle 18 is holstered, to introduce fuel into the fluid recapture path 96.

The fuel recapture component 94 can also be configured to enable reintroduction of the recaptured fuel into the fuel flow path 36. In particular, the fuel recapture path 96 may include a reintroduction path 96*d* that is in fluid communication with the return path 96*c* and the fuel flow path 36. The nozzle 18 may include a secondary vacuum path or suction path 77 that is in fluid communication with or defines part of the reintroduction path 96*d*. In particular, the venturi seat ring 74 may include one or more generally radially-extending passages 77 (which are offset from the radially-extending passages 75) defining a secondary vacuum which creates a negative pressure in the secondary vacuum path 77 when fuel flows past the venturi poppet 70, similar to the venturi/vacuum formed in passages 75 by the venturi poppet 70 described above in the context of the automatic shut-off. In one case, the venturi poppet seating ring 74 can be a split vacuum venturi ring, creating a primary vacuum for the venturi chamber 80/shut-off device 82 and a secondary venturi vacuum for evacuation of the fuel recapture path 96. For example, a secondary venturi is provided in U.S. Pat. No. 5,435,357 to Woods et al., the entire contents of which are incorporated herein.

In this manner, during dispensing of fuel by the nozzle 18, the flow of fuel causes a vacuum in the secondary vacuum path 77 and the reintroduction path 96. Any fuel positioned in the fuel recapture path/reintroduction path 96 can be sucked out of the fuel recapture path 96 and introduced into the fuel path 36 by the secondary vacuum, as shown by the arrows in FIG. 5.

Thus, in this manner, the fuel recapture component/system 94 can capture fuel or fluid on the outside of the spout 54, preventing the fuel from coating the handle 66 or other portions of the nozzle 18 handled by a user/operator. The fuel recapture path 96 can define a serpentine path, including at least one baffle such that liquid that enters the fluid recapture path 96 has a limited ability to exit the same way that it entered, but instead exits via the reintroduction path 96*d*. In addition, the recaptured fuel can be reintroduced into the fluid flow path 36, reducing the amount of wasted fuel and providing environmental benefits, and reducing drips from the spout 54. The capture of fuel also helps to prevent introduction of fuel into joints or other portions of the nozzle 18, which can accelerate wear, particularly with respect to plastic or rubber parts, painted surfaces, etc. These benefits can be particularly useful when the system is utilized with fluids or fuels having a low vapor pressure, such as diesel fuel, which evaporates slowly and can reside on the nozzle 18 for extended periods of time if not recaptured.

Figure 6:
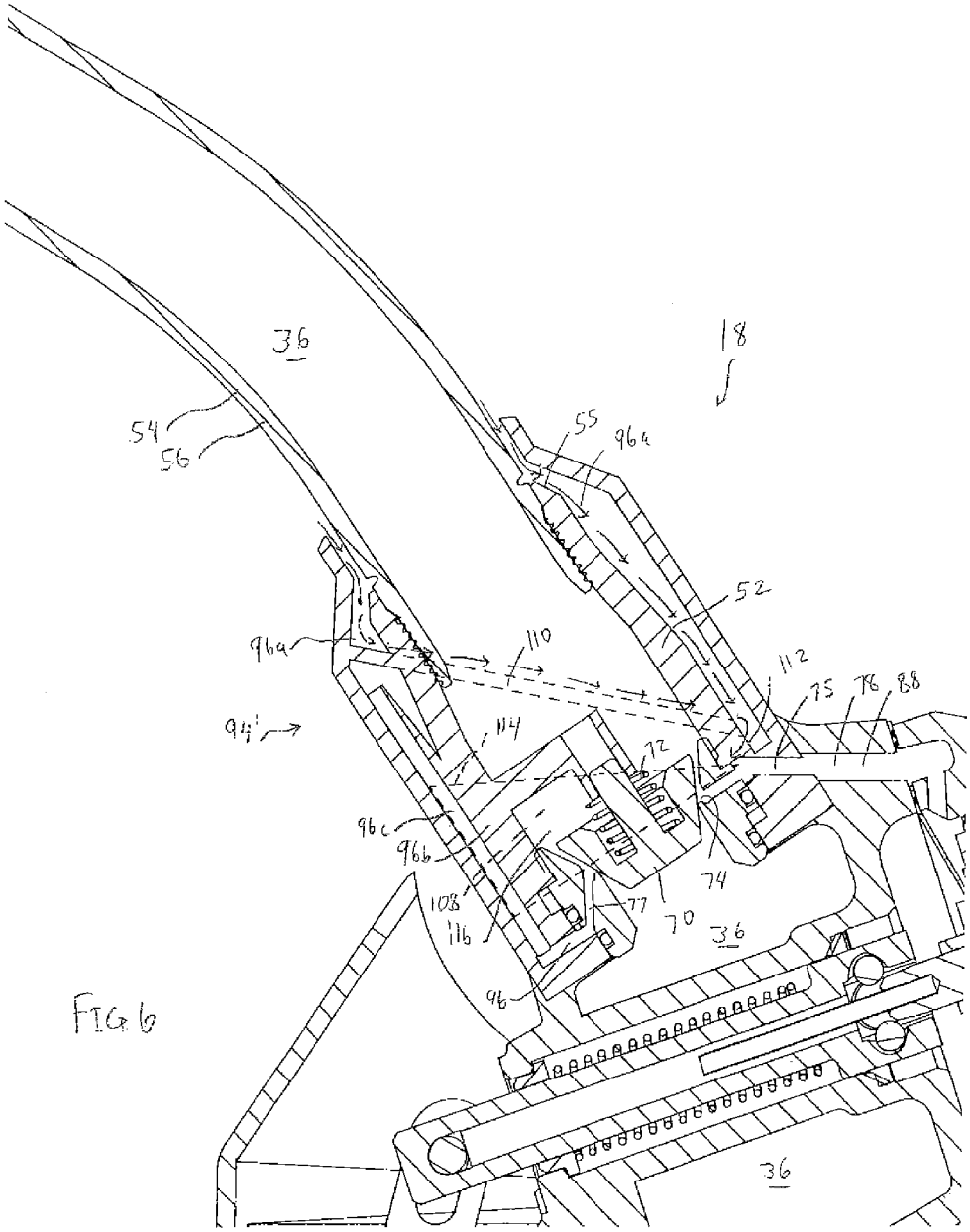
FIG. 6 is a detail side cross section showing a nozzle portion with alternate fuel recapture feature, with the nozzle in the storage position.
Figure 7:
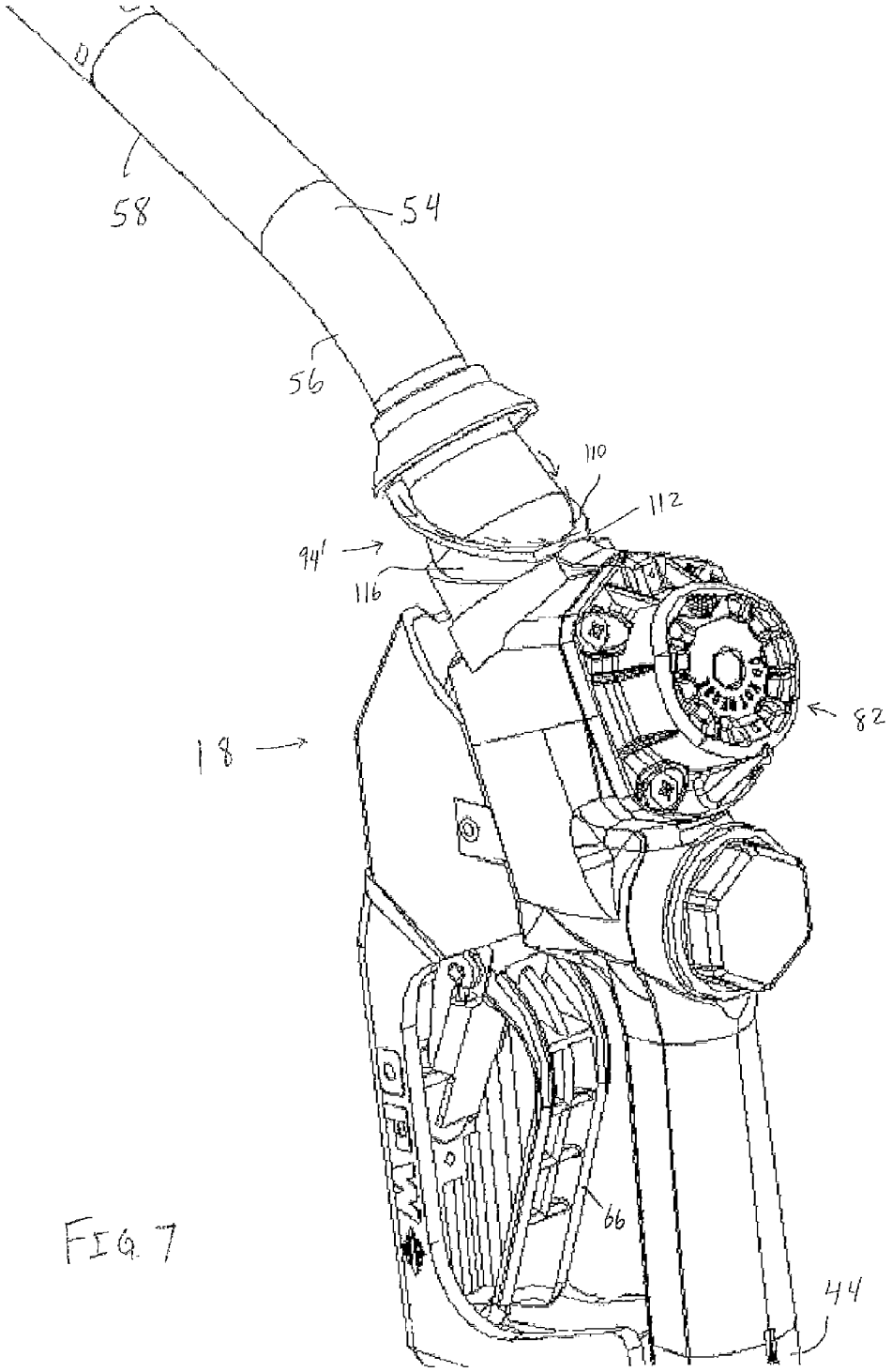
FIG. 7 is a side perspective view of the nozzle portion of FIG. 6, with portions of the fuel recapture component removed for illustrative purposes.
Figure 8:
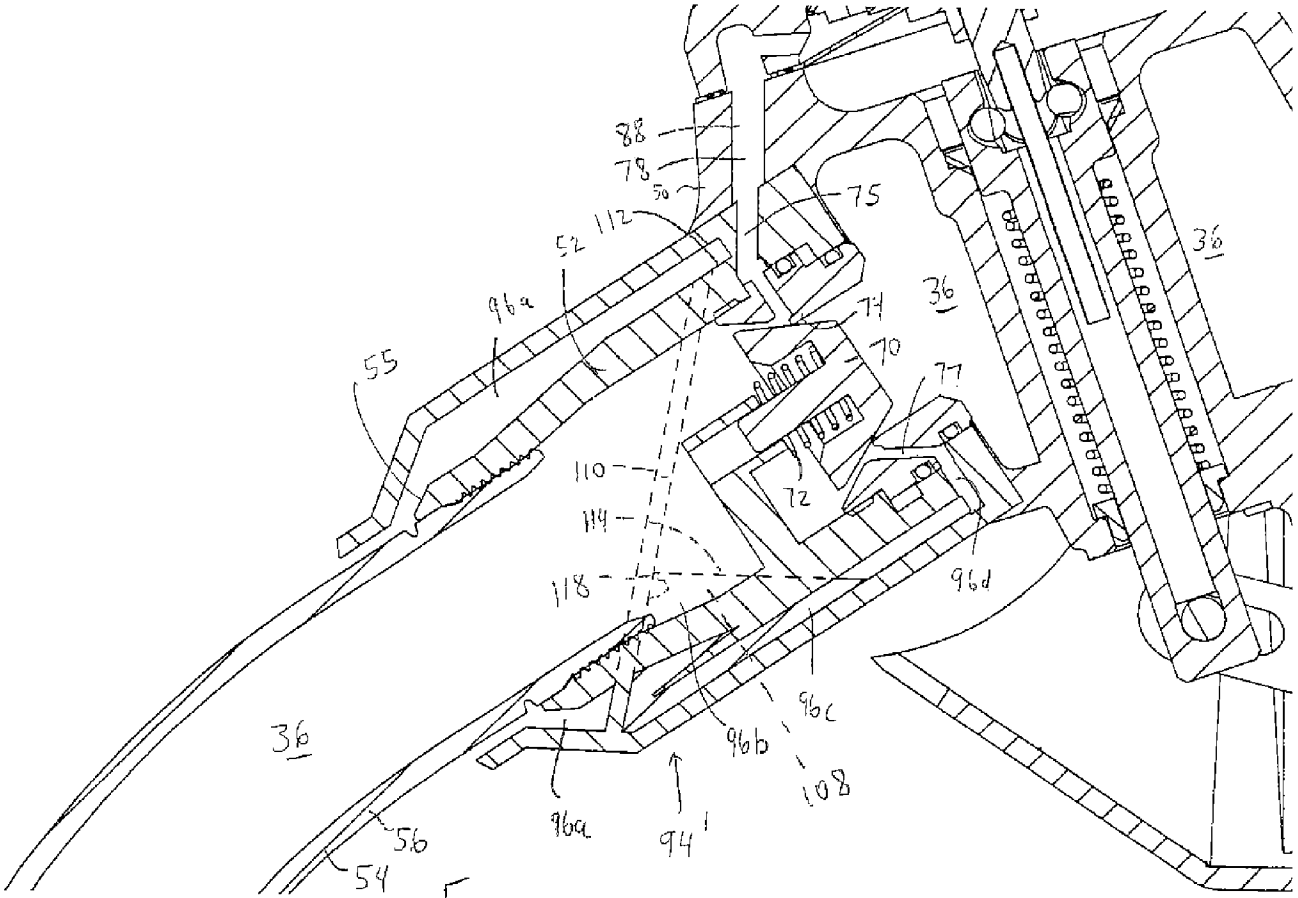
FIG. 8 is a detail side cross section of the nozzle portion of FIG. 6, shown in a dispensing position.

FIGS. 6-8 illustrate an alternate embodiment of the fuel recapture component 94'. In this case, the intake path 96*a* can be structured somewhat similar to that of the embodiment of FIGS. 2-5. However, in the embodiment of FIGS. 6-8, the baffle 110 separating the intake path 96*a* from the reservoir portion 96*b* is angled with respect to a radial plane of the spout 54. In particular, the baffle 110 can be formed as a generally oval-shaped ring (see FIG. 7) which directs captured fluid downwardly and around the baffle 110 when the spout 54 is oriented vertically, as shown by the arrows in FIGS. 6 and 7. The baffle 110 can be generally circumferentially-extending and positioned at an angle relative to radial plane of the nozzle 18.

Once the recaptured fluid reaches the bottom end of the baffle 110 (when the nozzle 18 is holstered), the captured fluid passes through an opening/gap 112 of the baffle 110 and enters the reservoir portion 96*b*/return path 96*c* below the baffle 110 and is trapped therein. For example, as shown in FIG. 6, trapped fluid 108 in the reservoir portion 96*b* is positioned below/beyond the baffle 110, and the upper extent of the trapped fluid, in one illustrated embodiment, is defined by dashed line 114. The trapped fluid 108 fills the space 116 (see FIG. 7) below the baffle 110 when the nozzle 18 is holstered.

As shown in FIG. 8, when the nozzle 18 is moved to its horizontal or dispensing position, the trapped fluid 108 engages the underside or upstream surface 118 of the baffle 110, which traps the fluid in the fuel recapture component 94'. The upper edge of the trapped fluid 108 is again shown by dashed line 114 in FIG. 8. The embodiment of FIGS. 6-8 can provide greater volume capacity to the reservoir portion 96*b*/return path 96*c* such that greater volumes of recaptured fuel can be stored in the fuel recapture component 94'. Similar to the embodiment of FIGS. 3-5, in the embodiment of FIGS. 6-8 the fluid recapture path 96 includes a reintroduction path 96*d* in fluid communication with the secondary vacuum 77 such that fluid in the recapture path 96 can be returned to the fluid flow path 36.

In the embodiments shown in FIGS. 2-8, the axially forward portion of the fluid recapture path 96, which is the bottom-most portions of the fluid recapture path 96 when the nozzle 18 is in its dispensing position (i.e. where recaptured fuel pools during refueling), is defined by a closed volume/seamless cavity without engaging any valves (i.e. the venturi poppet 70) or movable component, and therefore fluidly sealed. Thus, in the embodiments of FIGS. 2-8, fluid is trapped at the bottom, sealed end of the fuel recapture path 96 to avoid any potential leakage issues.

Figure 9:
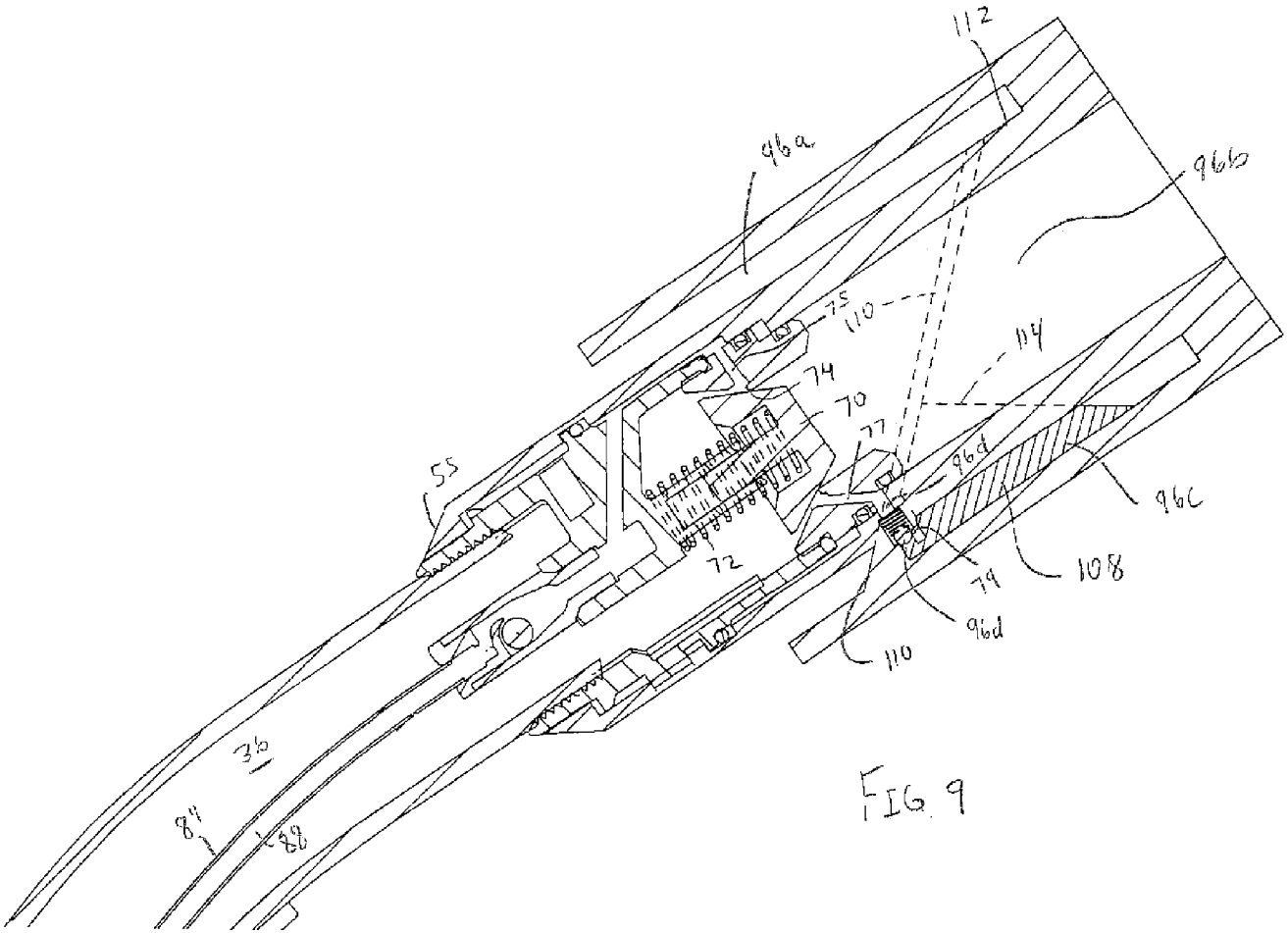
FIG. 9 is a detail side cross section showing a nozzle portion with yet another alternate fuel recapture feature.

In another alternate embodiment, as shown in FIG. 9, the reintroduction path 96*d* of the fluid recapture path 96 is at or near the lowest point of the fluid recapture path 96, when the nozzle 18 is in its dispensing position. Moreover, in this case the reintroduction path 96*d*/secondary vacuum 77 is in direct fluid communication with the fluid path 35/venturi poppet 70. In this case, then, if the poppet 70 were to form an imperfect seal against the secondary vacuum port 77, fluid could leak past the poppet 70 when the nozzle 18 is in its dispensing position. Thus a check valve 79, that is biased closed, can be positioned in the secondary vacuum port 77 and/or reintroduction path 96*d*. The check valve 79 can help to prevent fluid from draining out of the fluid recapture path 96 and into the fluid dispensing path 36 when the nozzle 18 is in the dispensing position, but not dispensing fluid. The check valve 79 can thereby help to prevent nuisance drips out of the spout 54 when the nozzle 18 is not being utilized. The check valve 79 can be opened, to allow captured fuel 108 to be reintroduced, when sufficiently low pressure is applied thereto (e.g. by the secondary vacuum 77).

Figure 10:
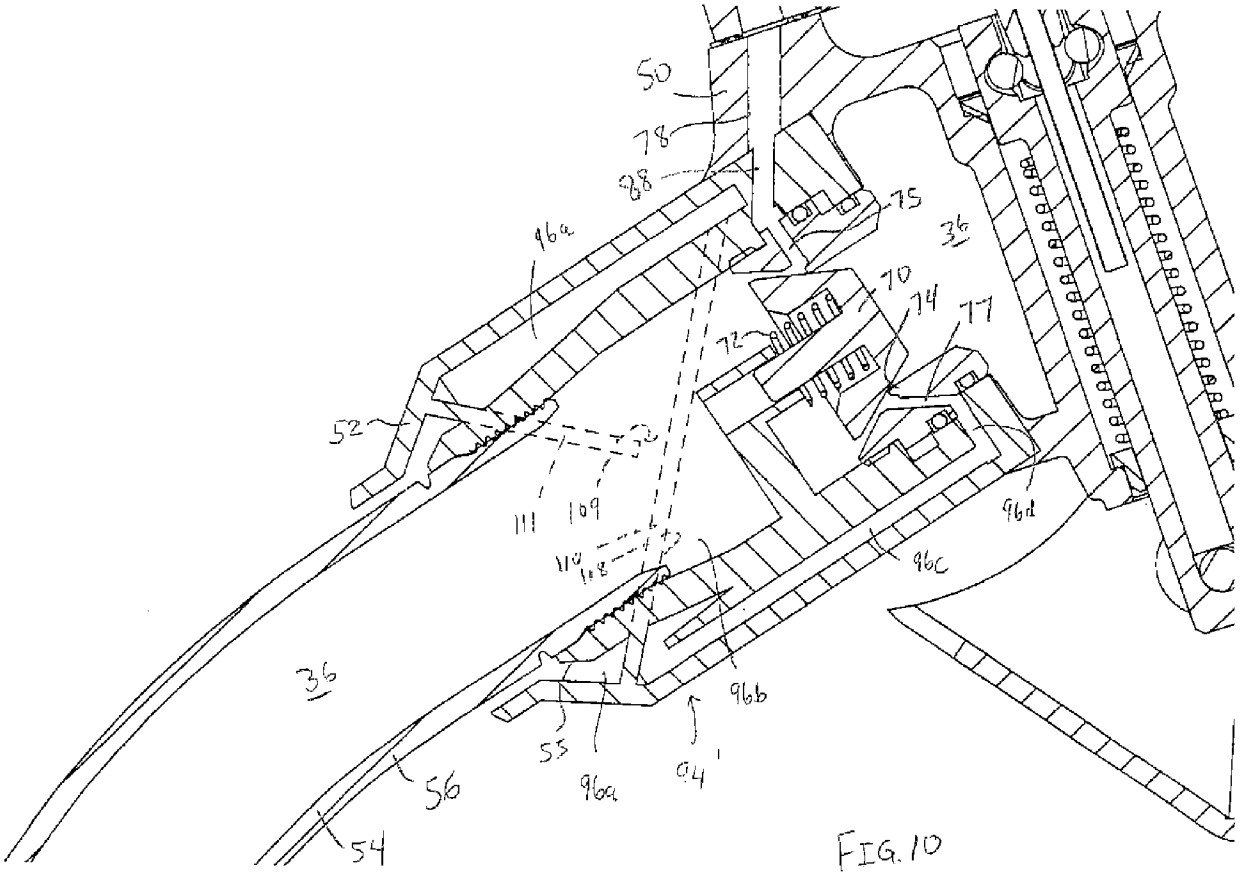
FIG. 10 is a detail side cross section showing a nozzle portion with yet another alternate fuel recapture feature.

In the embodiments of FIGS. 6-9, it may be possible to cause trapped/recaptured fluid 108 to flow out of the fluid recapture path 96, and back down along the spout 54, if the nozzle 18 were to be manipulated in a relatively unusual manner. In particular, if the nozzle 18 were to be unholstered and pivoted backwardly about a transverse axis approximately 90° or more, recaptured fuel 108 might be able to flow out of the nozzle 18. As shown in FIG. 10, if desired a second baffle 111 can be added in the fuel recapture path 96 to prevent fuel escape due to this type of manipulation of the nozzle 18. The second baffle 111 can extend generally circumferentially downwardly from an upper surface of the fuel capture component 96', but leave a gap 109 between the baffles 110, 111 to allow liquid to enter the reservoir portion **96*b* during standard fuel recapture, as shown by the arrows in FIG. 6 The second baffle 111 creates a second chamber which can contain fluid 108 if the nozzle 18** were to be manipulated in the manner described above. Moreover, if desired, tertiary and other baffles can be added to add further liquid trapping features.

Figure 11:
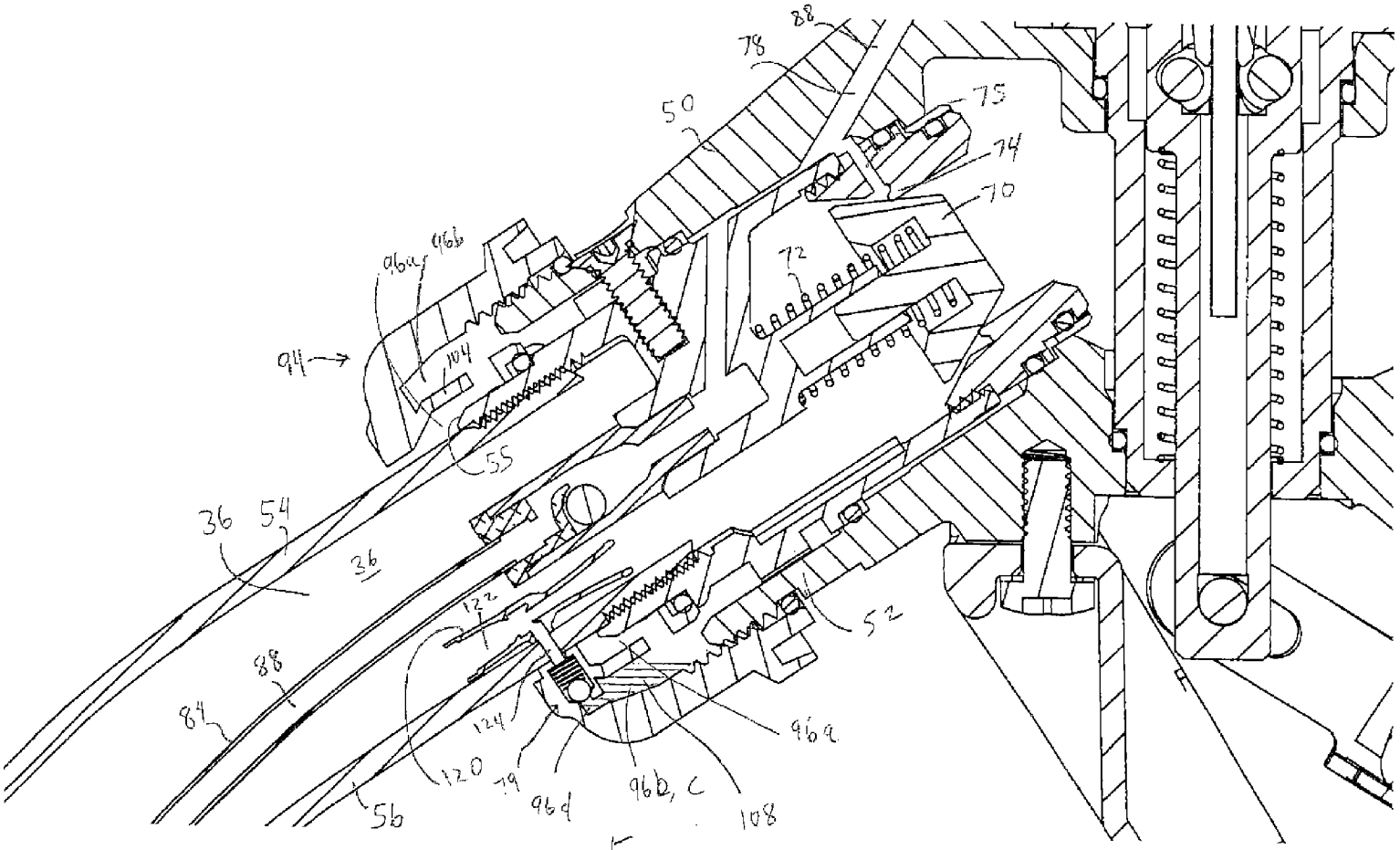
FIG. 11 is a detail side cross section showing a nozzle portion with yet another alternate fuel recapture feature.

In the embodiments disclosed above, the secondary vacuum utilized to pull fluid from the recapture path 96 is implemented utilizing a venturi created by the venturi poppet 70. However, the venturi/suction forces can be created by other suction force generators, methods and devices. For example, FIG. 11 illustrates an alternate embodiment for providing suction in the form of a venturi tube 120 positioned in the fluid flow path 36. The venturi tube 120 has a central cavity 122 through which fluid can pass during fuel dispensing, which generates a venturi or suction forces in the feeder path 124 extending generally perpendicular to the central cavity 122. In this manner, when fluid flows through the fluid path 36 and venturi tube 120, suction forces are created in the feeder path 124, which is in fluid communication with the reintroduction path **96*d* and the central cavity 122, to pull the fluid out of the fluid recapture path 96*d* and into the main fluid path 36. A check valve 79, analogous to the check valve 79 in the embodiment of FIG. 9, can be utilized to prevent undesired escape of trapped fuel from the recapture path 96**.

FIG. 11 illustrates the venturi tube 120 positioned downstream, and in series with, the poppet valve 70. However, if desired, the venturi tube 120 can be placed in parallel with the poppet valve 70, diverting a small portion of the fluid flow to create the desired vacuum forces. Moreover, if desired, the venturi tube 120 disclosed and shown herein can be utilized in conjunction with any of the fuel recapture arrangements described and shown herein.

In one embodiment, the fluid recapture path 96/fuel recapture component 94 constitutes or is defined by a sleeve or external body which can be fitted or retrofitted onto an existing nozzle 18. For example, in the illustrated embodiment the fuel recapture component 94 is threadably coupled to and around the spout adapter 52. Alternately, the fluid recapture path 96/fuel recapture component 94 can be integrally formed with the nozzle 18. In any case, the fuel recapture component/system 94 can capture fuel or fluid on the outside of the spout 54, preventing the fuel from coating the handle 66. The recaptured fuel can be reintroduced into the fluid flow path 36, reducing the amount of wasted fuel and providing environmental benefits. The capture of fuel can also help to reduce exposure of the outer components of the nozzle 18 to fuel/fluid, thereby prolonging the useful life of the nozzle 18.

Having described the invention in detail and by reference to the various embodiments, it should be understood that modifications and variations thereof are possible without departing from the scope of the invention.

What is claimed is:

1. A nozzle comprising:

a dispensing path configured such that fluid is dispensable therethrough;

a suction path configured such that a negative pressure is created therein when said fluid flows through said dispensing path;

a sensing path configured such that a negative pressure is created therein when said fluid flows through said dispensing path, wherein said sensing path is operatively coupled to a shut-off device; and a fluid recapture path configured to capture therein said fluid positioned on an outside of said nozzle, wherein said fluid recapture path is in fluid communication with said dispensing path and said suction path such that said fluid in said fluid recapture path is directable into said dispensing path by said negative pressure, wherein said nozzle is movable between a dispensing position and a storage position, wherein said fluid recapture path is configured such that when said nozzle is in said storage position said fluid flowing down said outside of said nozzle is receivable into said fluid recapture path, and wherein said fluid recapture path is configured to form a fluid trap such that when said nozzle is moved from said storage position to said dispensing position at least part of any of said fluid in said fluid recapture path is trapped therein and blocked from exiting said fluid recapture path.

2. The nozzle of claim 1 wherein said nozzle includes a spout and said fluid recapture path is generally positioned below said spout when said spout is in said storage position, and wherein said fluid recapture path is generally positioned above said spout when said spout is in said dispensing position.

3. The nozzle of claim 1 wherein said fluid recapture path includes an intake path and a return path, wherein said return path is positioned radially outside said intake path, and wherein said return path is fluidly coupled to said suction path.

4. The nozzle of claim 1 wherein said fluid recapture path is configured such that when said nozzle is in said dispensing position a lower-most portion of said fluid in said fluid recapture path is trapped in said fluid trap.

5. The nozzle of claim 1 wherein said nozzle includes a nozzle body and spout, and wherein a distal end of said dispensing path is positioned at a distal end of said spout, and wherein said fluid recapture path is positioned at a base end of said spout.

6. The nozzle of claim 1 further comprising a poppet valve positioned in said dispensing path such that when fluid of a sufficient pressure flows through said dispensing path said poppet valve is opened such that said fluid creates said negative pressure in said suction path by a venturi effect.

7. The nozzle of claim 6 wherein said poppet valve is configured such that when said fluid of a sufficient pressure flows through said dispensing path and said poppet valve is opened said fluid creates said negative pressure in said sensing path by said venturi effect, wherein the nozzle further includes said shut-off device operatively coupled to said sensing path such that when said sensing path is blocked said shut-off device moves to a closed position to block said nozzle from dispensing said fluid through said dispensing path.

8. The nozzle of claim 7 wherein said shut-off device includes a tube including an opening positioned at or adjacent to an end of said nozzle, wherein said tube at least partially defines or is in fluid communication with said sensing path.

9. The nozzle of claim 1 further comprising a venturi tube positioned in said dispensing path and in fluid communication with said suction path such that when said fluid of sufficient pressure flows through said venturi tube said negative pressure is created in said suction path.

10. The nozzle of claim 1 wherein said fluid recapture path includes a generally circumferentially-extending baffle positioned at an angle relative to radial plane of said nozzle.

11. The nozzle of claim 10 wherein said baffle is configured to guide downwardly-flowing fluid to an opening through which said downwardly-flowing fluid can pass such that once said downwardly-flowing fluid passes through said opening said downwardly-flowing fluid is generally trapped in said fluid recapture path.

12. The nozzle of claim 1 wherein nozzle includes a spout and said dispensing path is positioned in said spout, said nozzle further including a body positioned adjacent to said spout such that said fluid recapture path is positioned between said spout and said body, wherein said body and said spout define a radially-extending gap therebetween defining an intake path in fluid communication with said fluid recapture path.

13. The nozzle of claim 1 wherein said fluid recapture path includes an exit path, and wherein said nozzle includes a generally axially-extending baffle at least partially defining said fluid trap, wherein said fluid trap at least partially axially overlaps with but is radially offset from said exit path when said nozzle is in said dispensing position to trap said fluid therein.

14. A nozzle comprising:

a nozzle body having a spout and a dispensing path configured to dispense fluid therethrough, the nozzle body further including a sensing path configured such that a negative pressure is created therein when said fluid flows through said dispensing path, wherein said sensing path is operatively coupled to a shut-off device;

a fluid recapture path configured to receive therein said fluid positioned on an outside of said spout, wherein said fluid recapture path is configured to return recaptured fluid to said dispensing path in said nozzle and a suction path configured to have a negative pressure generated therein when said fluid flows through said dispensing path, and wherein said fluid recapture path is in fluid communication with said suction path such that said fluid in said fluid recapture path is directable into said dispensing path by said negative pressure in said suction path.

15. The nozzle of claim 14 wherein said nozzle is configured such that said fluid flowing through said dispensing path is configured to cause said fluid in said fluid recapture path to be evacuated from said fluid recapture path into said dispensing path.

16. The nozzle of claim 14 wherein the nozzle further includes a suction force generator configured to create a negative pressure when said fluid flows through said dispensing path, wherein said suction force generator is operatively coupled to said suction path to cause said fluid in said fluid recapture path to be moved from said fluid recapture path into said dispensing path.

17. The nozzle of claim 14 wherein said fluid recapture path is configured to receive therein said fluid positioned on said outside of said spout at or adjacent to a base portion of said spout.

18. The nozzle of claim 17 wherein said nozzle includes said base portion and an end portion that is angled relative to said base portion.

19. The nozzle of claim 17 wherein said fluid recapture path is configured such that said fluid positioned on said outside of said spout is first introduced into said fluid recapture path at or adjacent to said base portion.

20. The nozzle of claim 17 wherein said fluid recapture path is configured to receive therein fluid positioned on an outside of said spout at said base portion of said spout located opposite a distal end thereof.

21. The nozzle of claim 14 wherein said fluid recapture path is configured to receive therein said fluid positioned on an outermost radial surface of said spout exposed to an ambient environment.

22. The nozzle of claim 14 wherein said nozzle is configured such that said negative pressure in said sensing path is created therein by said fluid flowing through said dispensing path.

23. The nozzle of claim 14 wherein said fluid recapture path is configured to receive therein liquid fluid positioned on an outermost radial surface of said spout exposed to an ambient environment.

24. A nozzle comprising:

a spout;

a dispensing path in said spout and configured such that fluid is dispensable therethrough;

a suction path configured such that a negative pressure is created therein when said fluid flows through said dispensing path;

a sensing path configured such that a negative pressure is created therein when said fluid flows through said dispensing path; and a body positioned on an outer surface of said spout and defining a fluid recapture path therebetween, said fluid recapture path being configured to receive therein said fluid positioned on an outside of said nozzle, wherein said fluid recapture path is in fluid communication with said dispensing path and said suction path such that said fluid in said fluid recapture path is directable into said dispensing path by said negative pressure, said body and said spout defining a radially-extending gap therebetween defining an intake path that fluidly communicates with said fluid recapture path.

25. The nozzle of claim 24 wherein said intake path extends in a circumferential direction.

26. The nozzle of claim 25 wherein said intake path extends 360 degrees about an entire perimeter of said spout.

27. A nozzle including a spout and comprising:

a dispensing path configured such that fluid is dispensable therethrough;

a suction path configured such that a negative pressure is created therein when said fluid flows through said dispensing path; and a fluid recapture path configured to receive therein said fluid positioned on an outermost surface of said spout exposed to an ambient environment, wherein said fluid recapture path is in fluid communication with said dispensing path and said suction path such that said fluid in said fluid recapture path is directable into said dispensing path by said negative pressure, at least part of fluid recapture path extending circumferentially around said outermost surface at or adjacent to a base portion of said spout to capture said fluid flowing down said outermost surface.

28. A nozzle comprising:

a dispensing path configured such that fluid is dispensable therethrough;

a suction path configured such that a negative pressure is created therein when said fluid flows through said dispensing path;

a sensing path configured such that a negative pressure is created therein when said fluid flows through said dispensing path, wherein said sensing path is operatively coupled to a shut-off device; and a fluid recapture path configured to receive therein said fluid positioned on an outside of said nozzle, wherein said fluid recapture path is in fluid communication with said dispensing path and said suction path such that said fluid in said fluid recapture path is directable into said dispensing path by said negative pressure, wherein said fluid recapture path is fluidly isolated from said shut-off device.

29. The nozzle of claim 28 further comprising said shut-off device, wherein said shut-off device is configured to block said nozzle from dispensing said fluid through said dispensing path when fluid is detected at or adjacent to a tip of said nozzle.

30. The nozzle of claim 1 wherein the nozzle is configured to dispense a petroleum-based fuel.

* * * * *